United States Patent [19]

Zank

[11] Patent Number: 4,595,247

[45] Date of Patent: Jun. 17, 1986

[54] FOOD CABINET DRAWER SUPPORT

[75] Inventor: Jeffrey T. Zank, Milwaukee, Wis.

[73] Assignee: Alto-Shaam, Inc., Menomonee Falls, Wis.

[21] Appl. No.: 558,819

[22] Filed: Dec. 7, 1983

[51] Int. Cl.[4] ..... A47B 88/00; F16C 21/00

[52] U.S. Cl. ..... 312/343; 312/341 R; 384/19

[58] Field of Search ..... 312/341 R, 343, 344, 312/346, 348, 330 R; 308/3.6, 3.8; 298/430

[56] References Cited

U.S. PATENT DOCUMENTS

| | | | |
|---|---|---|---|
| 2,860,929 | 11/1958 | Gussack | 308/3.8 |
| 3,844,627 | 10/1974 | Gutner | 312/342 |

FOREIGN PATENT DOCUMENTS

| | | | |
|---|---|---|---|
| 1174453 | 11/1958 | France | 312/348 |
| 434624 | 4/1967 | Switzerland | 312/350 |
| 387655 | 5/1931 | United Kingdom | 312/343 |

*Primary Examiner*—William E. Lyddane

*Assistant Examiner*—Gerald A. Anderson

*Attorney, Agent, or Firm*—Andrus, Sceales, Starke & Sawall

[57] ABSTRACT

An improved support for effecting the sliding movement of a drawer utilized in an electric hot food cooking or holding cabinet. The support includes a drawer slide assembly removably mounted within the cabinet and a drawer frame assembly on the drawer. The drawer slide assembly has a channel-shaped drawer slide removably mounted to the side wall of the cabinet, and a drawer slide roller mounted on the slide for centering and guiding the drawer during its sliding movement. The drawer frame assembly includes a slide bearing track integrally formed in the side wall of the drawer to serve as the runner and guide for the slide roller, and a pair of rollers which roll above and below the slide. The drawer rollers and drawer slide are positioned in substantially vertical alignment as are the slide roller and drawer runner, but at a location inwardly of the drawer rollers, to lend added strength to the drawer assembly when the drawer is in its fully open position.

6 Claims, 5 Drawing Figures

FOOD CABINET DRAWER SUPPORT

BACKGROUND OF THE INVENTION

The present invention relates to electric food cooking and holding cabinets, and more particularly to an improved support for effecting the sliding movement of a drawer in such a cabinet.

Food cooking and holding cabinets may incorporate one or more drawers which hold various food items for cooking and dispensing.

The support typically found in such cabinets for effecting the sliding movement of a drawer therein is shown in FIG. 1. Such a support includes a pair of spaced apart rollers 10 and runners 11 mounted on a cabinet side wall 12, and corresponding pairs of spaced apart rollers 13 and runners 14 mounted on a side wall 15 of the drawer frame. Such a support is relatively expensive to manufacture. Also, the runners and rollers mounted on the cabinet wall cannot be removed without the use of tools. Thus, when the drawer is removed from the cabinet the rollers 10 and runners 11 provide obstructions which make cleaning of the cabinet interior difficult.

SUMMARY OF THE INVENTION

An improved support for effecting the sliding movement of a drawer in a cabinet or the like. The support includes a drawer and drawer slide assembly that are removable from the cabinet without the use of tools so that when the drawer slide assembly is removed from the cabinet the interior of the cabinet may be easily cleaned without the normal obstruction of rails, rollers and/or latches.

In order to accomplish this, the improved support includes a channel-shaped drawer slide removably mounted on the cabinet side wall with its web portion spaced from the cabinet side wall. The legs of the drawer slide thus form upper and lower guide rails for the drawer rollers. A drawer slide roller is mounted on the web portion of the drawer slide for centering and guiding the drawer and for minimizing the effort required to open and close the drawer. The removable mounting of the drawer slide includes first and second bolts projecting inwardly from the cabinet side wall that are receivable within openings formed in the web portion of the slide. The slide also includes a stop for prohibiting the accidental pulling of the drawer all the way out, but which also allows for easy, latch free removal of the drawer from the cabinet. Additionally, the slide includes a detent slot which serves as a means to pull and retain the drawer closed when the drawer has been pushed to a near closed position.

The drawer frame assembly includes upper and lower spaced apart drawer rollers rotatably mounted on the side wall of the drawer frame which roll above and below on the guide rails formed by the drawer slide. These drawer rollers add to the strength of the drawer assembly when the drawer is in its fully opened position. A runner or track is integrally formed in the side wall of the drawer frame and is located between the upper and lower drawer rollers. This track serves as the runner and guide rails for the slide roller.

The drawer rollers and drawer slide are disposed in substantially vertical alignment adjacent the cabinet side wall and the slide roller and drawer frame runner are also disposed in substantially vertical alignment but at a location inwardly of the drawer rollers and slide.

Such a construction enables the support to eliminate one of the rollers normally utilized in such supports in the past, and yet provide adequate support for the drawer when the drawer is in its fully open position. Also, such a construction enables the slide to be readily removable so that the cabinet interior may be easily cleaned.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
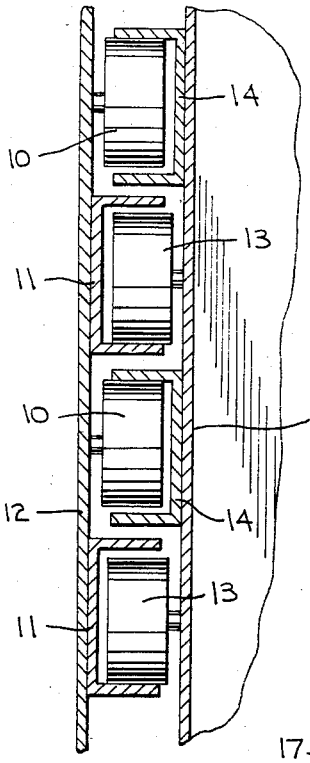
FIG. 1 PRIOR ART
FIG. 1 is a fragmentary cross sectional view in elevation of a typical prior art support for the drawer of a cabinet.
Figure 2:
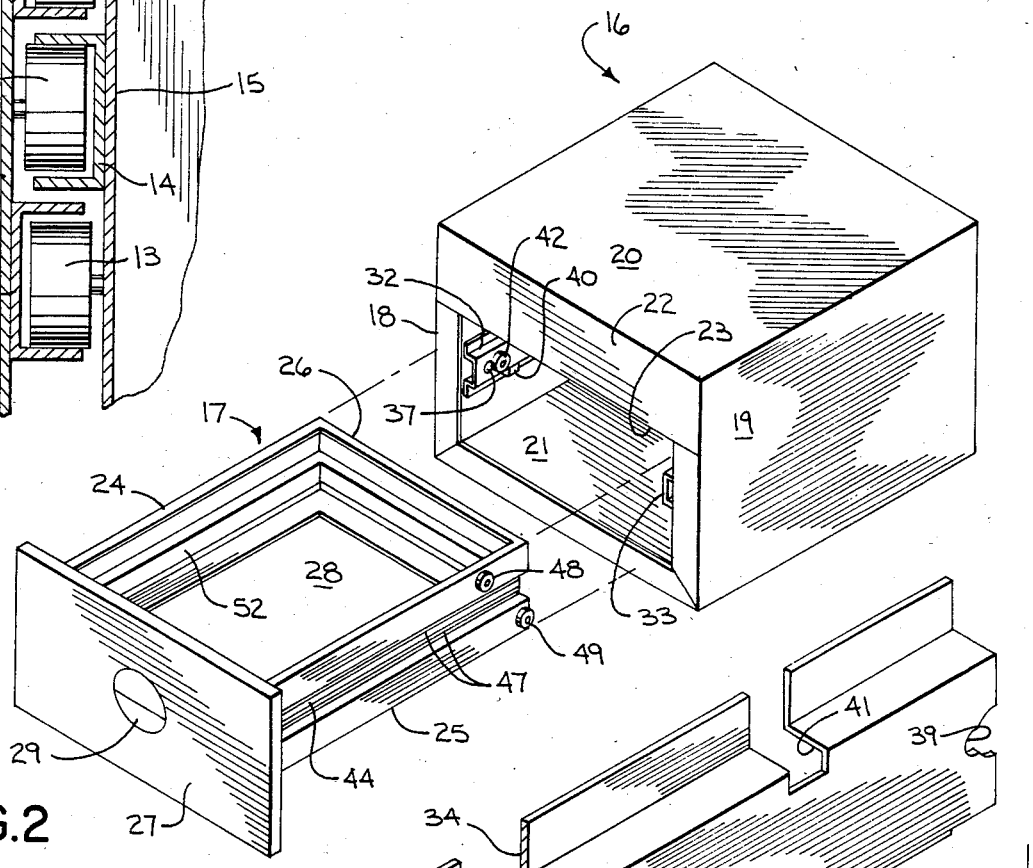
FIG. 2 is a perspective view illustrating a cabinet incorporating a support for a drawer constructed in accordance with the principles of the present invention.

Referring now to the drawings, FIG. 2 illustrates a cabinet 16 and a drawer 17 slidably received within cabinet 16 and movable between open and closed positions. Cabinet 16 may comprise a cooking oven or a warming and holding oven. Cabinet 16 has a pair of opposite side walls 18 and 19, a top wall 20, a bottom wall 21, a rear wall (not shown), and a front wall 22. A rectangular opening 23 is formed in front wall 22 for receiving drawer 17. Cabinet 16 may be heated in any conventional manner for cooking or keeping food items held in drawer 17 warm until serving.

Drawer 17 includes a box like rectangular frame having a pair of opposite side walls 24 and 25, a rear wall 26, a front wall 27 and a bottom 28. Front wall 27 includes a drawer pull 29 engageable by a users finger or hand to pull drawer 17 open or to push drawer 17 closed. As shown best in FIG. 4, front wall 27 is attached to side walls 24 and 25 by means of shoulder bolts 30 and cap nuts 31. Bolts 30 and nuts 31 allow the drawer front wall 27 to pivot slightly assuring a tight and uniform fit between drawer front wall 27 and cabinet front wall 22 when drawer 17 is in its closed position.

A support for drawer 17 is provided for effecting the sliding movement of drawer 17 within cabinet 16. The drawer support includes a drawer slide assembly on side walls 18 and 19 within cabinet 16 and a drawer frame assembly on side walls 24 and 25 of drawer 17. The drawer slide assembly includes a pair of drawer slides 32 and 33 removably mounted on side walls 18 and 19, respectively of cabinet 16. Since both drawer slides 32 and 33 are identical, only slide 32 will be described herein.

Figure 3:
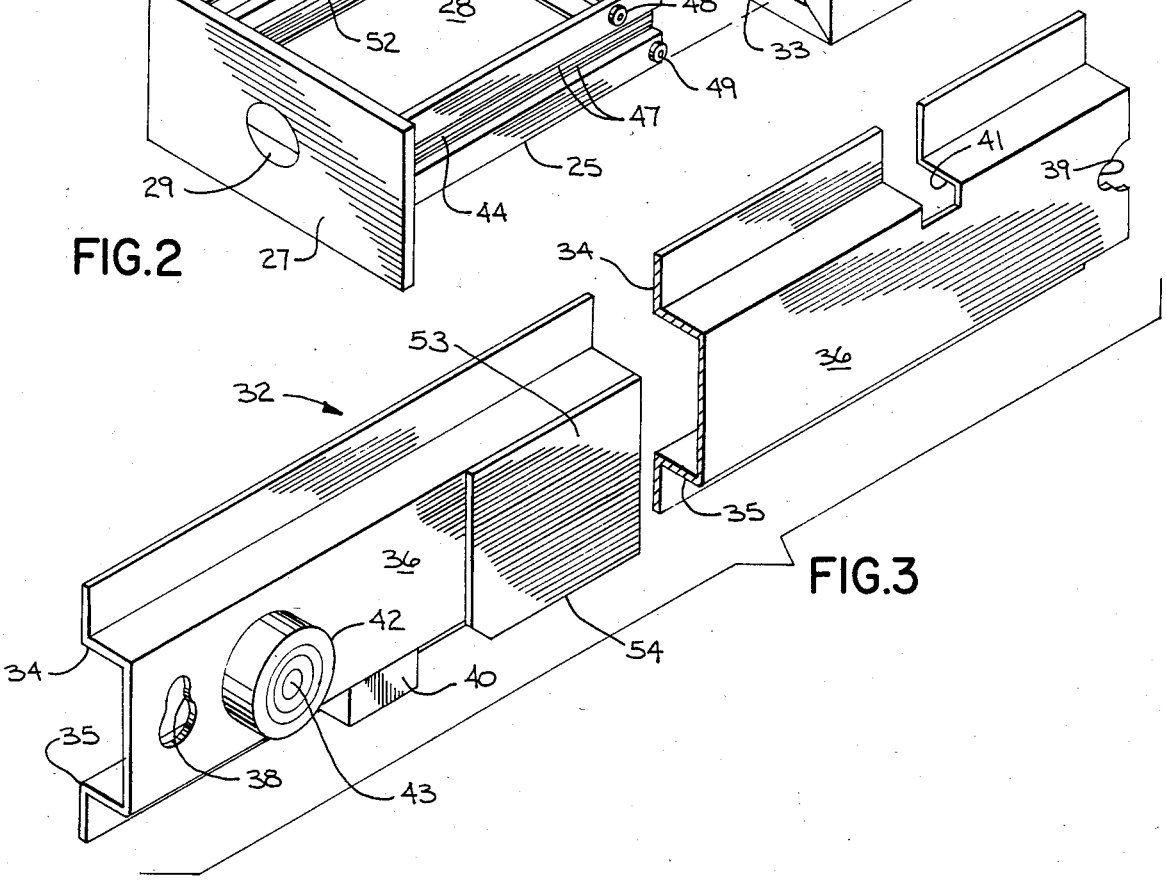
FIG. 3 is an enlarged perspective view illustrating the drawer slide assembly of the drawer support of FIG. 2.

Referring now to FIG. 3, drawer slide 32 is channel-shaped and includes an upper L-shaped guide rail 34, a lower L-shaped guide rail 35 and a web portion 36. Slide 32 has a length substantially identical to the length of side wall 18 and is removably mounted thereon so that web portion 36 is spaced from wall 18. The removable mounting is provided by a pair of bolts 37 (only one of which is shown in FIG. 2) projecting inwardly from cabinet side wall 18 and receivable within a corresponding pair of openings 38 and 39 formed in web portion 36 of slide 32. One bolt 37 is located near the open front of cabinet 16 and the other bolt 37 is located near the rear of cabinet 16. Opening 38 is formed in web portion 36 adjacent the front edge of slide 32 and includes an enlarged portion for easily enabling the head of bolt 37 to pass therethrough and a reduced portion having a diameter substantially equal to the diameter of the shank portion of bolt 37. Opening 39 on the other hand is formed in the rear edge of web portion 36 of slide 32. Rear opening 39 also includes an enlarged portion formed along the edge of web portion 36 and a reduced portion formed inwardly thereof. Thus, slide 32 may be readily removably mounted or hung on side wall 18 of cabinet 16 by inserting the rear bolt 37 within opening 39 and then passing the head of front bolt 37 through opening 38. This enables slide 32 to freely hang on side wall 18 and be readily removable without the use of tools so that the interior of the cabinet 16 may be easily cleaned.

Slide 32 also includes a drawer stop 40 spaced from the front edge of slide 32 and integrally formed on guide rail 35. Drawer stop 40 is in the form of a rectangular block and functions to prohibit the accidental pulling of drawer 17 all the way out, but yet allowing easy, latch free removal of drawer 17 from cabinet 16 when desired. Slide 32 also includes a roller engagement slot or detent 41 formed in guide rail 34 at a location spaced from the rear edge of slide 32. Detent 41 functions to provide a means for pulling and retaining the drawer 17 closed when drawer 17 has been pushed to a near closed position.

A retainer plate 53 is mounted on web portion 36 of slide 32. The top edge of plate 53 is flush with the rolling surface formed by guide rail 34 while its bottom edge 54 is spaced beneath the rolling surface of guide rail 35. Bottom edge 54 together with guide rail 35 form a channel along a portion of the length of slide 32, the purpose of which will hereinafter be described.

A drawer slide roller 42 is also mounted on web portion 36 of slide 32. Roller 42 is rotatably mounted on a stub shaft 43 upon an axis which is normal to web portion 36. Roller 42 is spaced from the front edge of slide 32 and is mounted adjacent to front opening 38, as shown best in FIG. 3. Roller 42 functions to center and guide drawer 17 and to minimize the effort required to open and close drawer 17.

Figure 4:
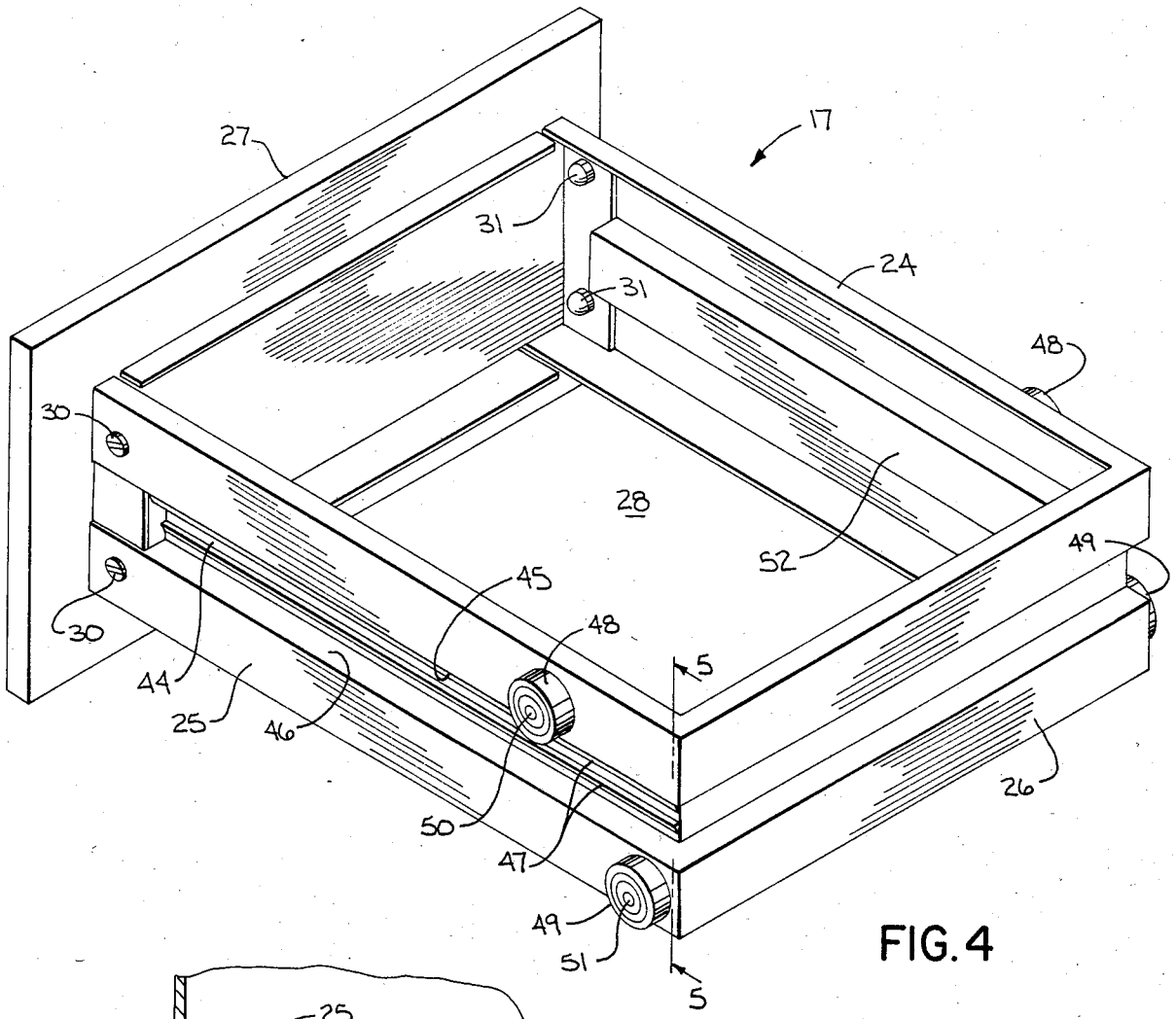
FIG. 4 is an enlarged perspective view illustrating the drawer frame assembly of the support of FIG. 2.
Figure 5:
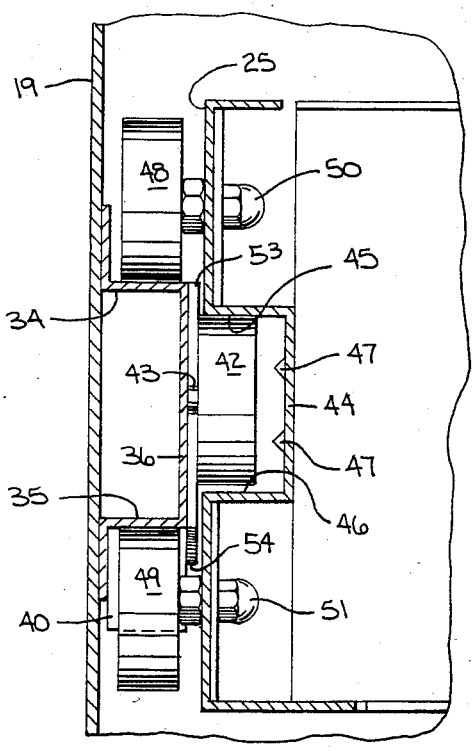
FIG. 5 is a fragmentary cross sectional view in elevation taken along the plane of the line 5—5 in FIG. 4 illustrating the support in its assembled condition.

Referring now to FIGS. 4 and 5, the drawer frame assembly includes a pair of slide roller tracks or runners 52 and 44 integrally formed in side walls 24 and 25, respectively, of drawer 17. Since both runners 44 and 52 are identical, only runner 44 and its corresponding components will be described herein. Runner 44 is U-shaped and extends substantially the entire length of side wall 24. Runner 44 includes an upper guide rail 45 and a lower guide rail 46 which act as bearing surfaces for roller 42. Runner 44 also includes a pair of projections 47 formed continuously from front to back which provide a pair of point contacts with the outer face of roller 42 to insure proper centering and guiding of drawer 17 when drawer 17 is being replaced within cabinet 16.

The drawer frame assembly also includes an upper drawer roller 48 and a lower drawer roller 49. Roller 48 is located above runner 44 and spaced from the rear edge of side wall 24 while lower roller 49 is located below runner 44 and immediately adjacent the rear edge of side wall 24. Both rollers 48 and 49 are rotatably mounted on stub shafts 50 and 51, respectively, about axes extending normal to the drawer side wall 24.

Bottom edge 54 of retainer plate 53 together with guide rail 35 forms a channel for slidably receiving roller 49. Since cabinet 16 is preferably employed as an oven, plate 53 functions to prevent any excessive lateral "play" in drawer 17 due to heat expansion of various components by limiting the lateral movement of roller 49 when drawer 17 is in its open position. Drawer 17 thus readily slides into and out of cabinet 16.

FIG. 5 illustrates the drawer support in its assembled condition and shows that rollers 48 and 49 and slide 32 are disposed in substantially vertical alignment adjacent the cabinet side wall 18 while drawer slide roller 42 and runner 44 are disposed in substantially vertical alignment but at a location inwardly of the rollers 48 and 49. Such a construction enables the drawer support to eliminate one of the four rollers which had typically been utilized in the past and thus reduce manufacturing costs as well as enable slide 32 to be removable from the cabinet side walls so that the interior of cabinet 16 may be easily cleaned without the normal obstructions of rails, rollers and/or latches. Additionally, this construction adds to the strength of the drawer assembly when the drawer 17 is in its fully open position.

Various modes of carrying out the invention are contemplated as being within the scope of the following claims particularly pointing and distinctly claiming the subject matter which is regarded as the invention.

I claim:

1. In combination, a cabinet having a pair of opposite side walls and an open front, a drawer slidably received within said cabinet and movable between open and closed positions, said drawer including a frame having a pair of opposite side walls disposed substantially parallel to the side walls of said cabinet, and a drawer support for effecting the sliding movement of said drawer, said support includes a channel-shaped drawer slide mounted on each cabinet side wall and extending along substantially the entire length of said cabinet side wall, said drawer slide includes an upper L-shaped guide rail, a lower L-shaped guide rail and a web portion spaced from said cabinet side walls and extending parallel thereto interconnecting the upper and lower guide rails of said slide, said upper and lower slide guide rails forming respective upper and lower rolling surfaces on said drawer slide; a slide roller mounted on the web portion of said drawer slide and rotatable about an axis extending normal to said cabinet side wall; a U-shaped drawer runner mounted on each drawer side wall and extending along substantially the entire length of said drawer side walls, said drawer runner includes an upper guide rail, a lower guide rail, said upper and lower runner guide rails forming respective upper and lower rolling surfaces which act as bearing surfaces for said slide roller and extending the length of said runner parallel to and adjacent to said slide for receiving said slide roller therein; upper and lower spaced apart drawer rollers mounted on the drawer side walls above and below said runner respectively and each rotatable about an axis extending normal to said drawer side wall and each engageable with the respective upper and lower rolling surfaces of said drawer slide, wherein said upper and lower drawer rollers and the guide rails of said drawer slide are disposed in substantially vertical alignment outside said drawer side walls and said slide roller and the guide rails of said drawer runner are disposed in substantially vertical alignment at a location inside said drawer side walls; and retainer means on the web portion of said drawer slide for preventing excessive lateral movement of one of said drawer roller when said drawer is in its open position.

2. The combination of claim 1, wherein said drawer runners are integrally formed in the side walls of said drawer.

3. The combination of claim 1, wherein the lower drawer roller is located at a position closely adjacent to the rear edge of the side wall of said drawer, and the upper drawer roller is located at a position spaced from the rear edge of said drawer side wall.

4. The combination of claim 1, wherein said support further includes means for removably mounting the drawer slides on said cabinet side wall.

5. The combination of claim 4, wherein the removable mounting means includes first and second bolts projecting inwardly from said cabinet side walls and receivable within openings formed in said slide, said first bolt located near the open front of said cabinet and the second bolt located near the rear of said cabinet.

6. The combination of claim 1, wherein one of the guide rails of said drawer slide includes a detent formed therein that receives one of the drawer rollers when said drawer is closed.

* * * * *